US005640142A

United States Patent [19]

Matatall, Jr. et al.

[11] Patent Number: 5,640,142

[45] Date of Patent: Jun. 17, 1997

[54] ALARM SYSTEM TESTING CIRCUIT

[75] Inventors: Richard Lewis Matatall, Jr., Springfield; Joseph John Turek, Jr., Wilbraham; Stanley Joseph Turek, E. Longmeadow, all of Mass.

[73] Assignee: Pittway Corporation, Syosset, N.Y.

[21] Appl. No.: 682,390

[22] Filed: Jul. 17, 1996

Related U.S. Application Data

[63] Continuation of Ser. No. 381,737, Feb. 1, 1995, abandoned.

[51] Int. Cl.[6] ..... G08B 29/00

[52] U.S. Cl. ..... 340/514; 340/506; 340/541; 340/521; 340/691

[58] Field of Search ..... 340/514, 506, 340/541, 521, 550, 566, 663, 691

[56] References Cited

U.S. PATENT DOCUMENTS

| | | | |
|---|---|---|---|
| 3,022,496 | 2/1962 | Bagno | 340/515 |
| 3,134,970 | 5/1964 | Kelly et al. | 340/515 |
| 3,324,532 | 6/1967 | Vandierendonck | 367/136 |
| 3,487,397 | 12/1969 | Kaplan et al. | 340/515 |
| 3,585,581 | 6/1971 | Aune et al. | 367/136 |
| 3,889,250 | 6/1975 | Solomon | 340/540 |
| 3,928,849 | 12/1975 | Schwarz | 340/515 |
| 3,958,213 | 5/1976 | Scott et al. | 340/566 |
| 3,974,489 | 8/1976 | Bleeker et al. | 340/514 |
| 4,054,867 | 10/1977 | Owens | 340/550 |
| 4,072,936 | 2/1978 | Spirig | 340/566 |
| 4,091,660 | 5/1978 | Yanagi | 73/658 |
| 4,134,109 | 1/1979 | McCormick et al. | 340/550 |
| 4,180,811 | 12/1979 | Yoshimura et al. | 340/566 |
| 4,195,286 | 3/1980 | Galvin | 340/501 |
| 4,196,423 | 4/1980 | Carver et al. | 340/566 |
| 4,307,387 | 12/1981 | Baxendale | 340/566 |
| 4,386,343 | 5/1983 | Shiveley | 340/566 |
| 4,668,941 | 5/1987 | Davenport et al. | 340/550 |
| 4,710,750 | 12/1987 | Johnson | 340/522 |
| 4,853,677 | 8/1989 | Yarbrough et al. | 340/544 |
| 4,920,332 | 4/1990 | Philippe | 340/544 |
| 4,928,085 | 5/1990 | DuRand, III et al. | 340/544 |
| 4,950,915 | 8/1990 | Spies et al. | 307/10.1 |
| 5,109,216 | 4/1992 | Yarbrough et al. | 340/544 |
| 5,117,220 | 5/1992 | Marino et al. | 340/550 |
| 5,164,703 | 11/1992 | Rickman | 340/515 |
| 5,192,931 | 3/1993 | Smith et al. | 340/550 |
| 5,323,141 | 6/1994 | Petek | 340/566 |
| 5,414,409 | 5/1995 | Voosen et al. | 340/541 |

*Primary Examiner*—Jeffery Hofsass
*Assistant Examiner*—Daryl C. Pope
*Attorney, Agent, or Firm*—Bryan Cave LLP

[57] ABSTRACT

A testing circuit for an alarm system is disclosed. The testing circuit is operable in an alarm system that includes a microphone for receiving an audio sound and a detector/generator for detecting audio characteristics in the audio sound corresponding to breaking glass and for generating an alarm signal in response thereto. The audio characteristics corresponding to breaking glass include first and second frequency components in timed relation, wherein the first frequency must be detected prior to the second frequency for an alarm to be generated. The testing circuit includes a trigger circuit for receiving the audio signal and for detecting the first-frequency component thereof, the trigger circuit activating the detector/generator in response to detection of the first-frequency component; a test circuit for periodically generating a test audio sound at the second frequency, the trigger circuit remaining operable to detect the first-frequency component during generation of the test audio sound; and circuitry operable during generation of the test audio sound for detecting the test audio sound and for (a) resetting the test circuit in response to detection of the test audio sound and (b) generating a fault signal upon non-detection of the test audio sound. The glass-break sensor is not disabled during a self-test and utilizes a test sound at a frequency that is normally used by the sensor for detecting breaking glass.

9 Claims, 3 Drawing Sheets

ALARM SYSTEM TESTING CIRCUIT

This is a continuation of U.S. application Ser. No. 08/381,737, filed Feb. 1, 1995, now abandoned.

BACKGROUND OF THE INVENTION

1. Field of the Invention

The present invention relates generally to testing circuits for glass-break sensors and more particularly to a testing circuit for a glass-break sensor in which the sensor is not disabled during a self-test and which utilizes a test sound at a frequency that is normally used by the sensor for the detection of breaking glass.

2. Description of the Related Art

Audio intrusion detection systems that detect the audio characteristics of breaking glass are well-known in the art. The simplest such systems use a microphone to detect the audio sound produced by the breaking glass and a threshold circuit to determine whether one or more of the frequency components of the sound exceed a predetermined threshold that is characteristic of breaking glass.

More complex glass-break detectors include timing/ comparison logic that compares the sound created by the microphone to the time-varying audio characteristics of breaking glass. These types of detectors isolate at least two frequency components of the audio sound and signal an alarm if the sound corresponds to the time-varying function, i.e., if certain frequencies are received at predetermined times and for predetermined durations.

For example, Petek, U.S. Pat. No. 5,323,141, concerns a glass-break sensor that includes a pair of microphones. Each microphone is used to detect one of the characteristic components of an acoustic wave generated by a glass-break. One of the microphones is used to detect a low-frequency signal and the other to detect a high-frequency signal.

Marino et al., U.S. Pat. No. 5,117,220, concerns a glass-break detector that detects structurally-transmitted vibrations and airborne sounds indicative of breaking glass. This system detects a low-frequency signal at about 200 Hz and a high-frequency signal at about 3–7 kHz. These signals are detected in accordance with a time-dependent function to provide an indication of breaking glass.

Smith et al., U.S. Pat. No. 5,192,931, concerns a glass-break detector that includes a low-frequency channel for detecting inward flex of a breaking window and a high-frequency channel for detecting the acoustic characteristics of breaking glass. The two channels are combined in a logic circuit that is timed so that the low-frequency flex is detected initially with detection of the high-frequency component following shortly thereafter. If both timing conditions are fulfilled, an alarm signal is generated. The low-frequency channel detects signals in the range of 50–100 Hz, and the high-frequency channel detects signals over a range of high frequencies.

Rickman, U.S. Pat. No. 5,164,703, concerns a supervisory circuit for use with an audio intrusion detection system. The system includes a first detector for detecting a low-frequency signal in the range of 3–30 Hz. Once the low-frequency signal has been detected, a circuit for detecting a higher frequency signal in the range of 7–16 kHz is enabled.

Davenport et al., U.S. Pat. No. 4,668,941, concerns a glass-break sensor that detects a low-frequency signal in the range of 350 Hz and a high-frequency signal in the range of 6.5 kHz. To generate an alarm signal, the low-frequency component must be detected first, with the high-frequency component detected a short time thereafter.

These patents exemplify various techniques for detecting the time-varying audio characteristics of breaking glass, including the use of different frequency components and different time-varying functions to model breaking glass.

Systems for testing glass-break sensors are also well-known in the art. In a typical testing system, the alarm triggering mechanism or the sensor triggering mechanism is disabled while a test signal is generated or an intrusion is simulated. Once the test is complete, the alarm trigger or sensor trigger is re-enabled.

The aforementioned U.S. Pat. No. 5,164,703 concerns a glass-break sensor in which the detection of a low-frequency signal is used to enable the detection of a high-frequency signal. If the high-frequency signal is then detected, an alarm is generated. A supervisory test circuit includes a self-test timer that initiates a self-test if the low-frequency signal is not received within a predetermined self-test time, preferably 19 hours. During the test, the high-frequency detection line is partially disabled while a test sound is generated. If the test sound is received by the microphone, the self-test timer is reset. If the test signal is not detected, an error signal is generated. Because the high-frequency detection line is partially disabled while the test sound is being generated, if a glass-break were to occur during the test, an alarm would not be generated. This is obviously disadvantageous in that the sensor could be defeated by breaking the glass while a test is taking place.

U.S. Pat. Nos. 3,022,496, 3,134,970, 3,487,397, 3,928,849, 3,974,489 and 4,386,343 concerns other types of testing systems for alarms. In each of these patents, the detection system is also disabled during a self-test. This renders each of these systems vulnerable to undetected break-in during testing.

Spies et al., U.S. Pat. No. 4,950,915, concerns an impact sensor for a vehicle. The impact sensor includes an acceleration sensor for detecting crash sounds, an evaluating circuit, and a trigger circuit for releasing an air-bag. For testing the impact sensor, an electro-acoustic transducer is provided in the sensor housing. During a self-test, the electro-acoustic transducer emits a test signal that is received by the acceleration sensor. The electrical signals that are produced by the acceleration sensor during the test are evaluated by a testing circuit to ensure that the acceleration sensor is in proper working condition. In a preferred embodiment, during testing the trigger circuit is disabled. In this embodiment, the air-bag, which is usually triggered by the impact sensor, could not be activated during a self-test. In an alternative embodiment, testing of the impact sensor may occur with the trigger circuit activated by selecting a test sound that is different from the sound necessary to activate the trigger circuit. This embodiment of the device enables the trigger circuit to remain active during a test but the acceleration sensor cannot be tested at a frequency at which it normally detects crash sounds.

Thus, there is a need for a glass-break sensor testing circuit that is not disabled during a self-test so that the system is not vulnerable to break-in during a test. It would be highly desirable to have such a glass-break sensor utilize a test sound at a frequency normally used by the sensor for detecting breaking glass.

SUMMARY OF THE INVENTION

This invention relates to a testing circuit for an alarm system that satisfies these needs and has other advantages that will be apparent. Broadly, the testing circuit of this invention may be used in an alarm system that includes:

(a) audio receiver/convertor means, preferably a microphone, for receiving an audio sound and for converting the audio sound to an audio signal; and (b) detector/generator means for detecting audio characteristics in the audio signal corresponding to breaking glass and for generating an alarm signal in response thereto. The audio characteristics corresponding to breaking glass include first and second frequency components in timed relation, wherein the first frequency must be detected prior to the second frequency for an alarm to be generated. Thus, the audio characteristics corresponding to breaking glass may have more than two frequency components in timed relation.

Alarm systems of this type are shown, for example, in the aforementioned U.S. Pat. Nos. 5,164,703, 5,117,220, and 5,192,931.

Broadly, the testing circuit of the invention comprises:

trigger means for receiving the audio signal and for detecting the first-frequency component thereof, the trigger means activating the detector/generator means in response to detection of the first-frequency component;

test means for periodically generating a test audio sound at the second frequency, the trigger means remaining operable to detect the first-frequency component during generation of the test audio sound; and means operable during generation of the test audio sound for detecting the test audio sound, said means (a) resetting the test means in response to detection of the test audio sound and (b) generating a fault signal upon non-detection of the test audio sound.

A preferred detector/generator circuit includes audio filters which divide the audio signal from the microphone into three bands: a low-frequency signal preferably less than 500 Hz; a mid-frequency signal preferably in the range 3 kHz–7 kHz; and a high-frequency signal preferably greater than 8 kHz. These signals are fed to a microprocessor that includes intrusion-detection logic to determine whether the audio signal has the audio characteristics of breaking glass. The high-frequency signal must be detected in order for the intrusion-detection logic to be initiated.

The microprocessor includes a software-based self-test timer. During steady-state operation, if no high-frequency signal is detected, the system determines if a middle-frequency signal is present. The self-test timer is incremented in each loop in which no middle-frequency signal is detected. If a middle-frequency signal is detected, the self-test timer is reset. The system then continues steady-state operation.

If no middle-frequency signal has been detected and the self-test timer has expired, a self-test is performed. The microprocessor causes a middle-frequency tone to be generated for the duration of the self-test. The system loops to determine whether the microphone has received the test sound. If a middle-frequency signal is detected, the self-test timer is reset and the system returns to steady-state operation. If no middle-frequency signal is received during the test, a system error is generated.

During the self-test, the system also polls for the presence of a high-frequency signal. If a high-frequency signal is detected during the self-test, the self-test is terminated, and control is transferred to the intrusion-detection logic. Thus, the intrusion-detection logic is not disabled during self-testing. If a high-frequency signal were to be received during a self-test, the intrusion-detection logic would automatically be activated.

A preferred method of testing an alarm system comprises the steps of:

receiving the audio signal and detecting the first-frequency component thereof;

activating the detector/generator means in response to detection of the first-frequency component;

periodically generating a test audio sound at the second frequency;

detecting the first-frequency component during generation of the test audio sound; and during generation of the test audio sound, detecting the test audio sound and (a) terminating the generation of the test audio sound in response to detection of the test audio sound and (b) generating a fault signal upon non-detection of the test audio sound.

More broadly, the invention is generally applicable in an intrusion-detection system which includes:

(a) receiver/convertor means for receiving an electro-magnetic signal; and (b) detector/generator means for detecting intrusion characteristics in the electro-magnetic signal corresponding to an intrusion and for generating an alarm signal in response thereto. The intrusion characteristics include first and second frequency components in timed relation, the first frequency component having a first frequency, and the second frequency component having a second frequency, wherein the first frequency must be detected prior to the second frequency for an alarm to be generated.

In this embodiment, the testing circuit comprises:

trigger means for receiving the electro-magnetic signal and for detecting the first-frequency component thereof, the trigger means activating the detector/generator means in response to detection of the first-frequency component;

test means for periodically generating a test signal at the second frequency, the trigger means remaining operable to detect the first-frequency component during generation of the test signal; and means operable during generation of the test signal for detecting the test signal, said means (a) resetting the test means in response to detection of the test signal and (b) generating a fault signal upon non-detection of the test signal.

Thus, the present glass-break sensor testing circuit is not disabled during a self-test and utilizes a test sound at a frequency that is normally used by the sensor for detecting breaking glass.

BRIEF DESCRIPTION OF THE DRAWINGS

To facilitate further discussion of the invention, the following drawings are provided in which.

DESCRIPTION OF THE PREFERRED EMBODIMENT

The present invention is a testing circuit for an audio intrusion detection system. Although the audio intrusion detection system is preferably a glass-break sensor, the invention is also applicable to other types of sensors, including seismic and crash-detection sensors. The testing circuit is applicable to audio intrusion detection systems of the type which: a) receive an audio signal and b) detect at least two frequency bands of the signal in a timed relationship to determine if an alarm should be triggered. Systems of this type are shown, for example, in the aforementioned U.S. Pat. Nos. 5,164,703, 5,117,220, and 5,192,931. While the invention will be described with respect to a preferred embodiment using preferred audio processing circuitry, it is applicable to these other systems as well. Moreover, while various audio filters will be described herein, the particular characteristics of each filter are not critical and may be modified in various respects within the scope of the invention.

The glass-break sensor incorporating the testing circuit of the invention is used to trigger an alarm in conjunction with a conventional alarm box, which is not part of the present invention. The sensor is preferably enclosed in a plastic housing or other suitable enclosure for being mounted to a wall or ceiling. A conventional audio transducer 2, preferably a microphone, is contained within the housing. Microphone 2 detects audio sounds near the device and converts the sounds to an audio signal, preferably an electrical audio signal, corresponding to the audio sound.

Figure 1:
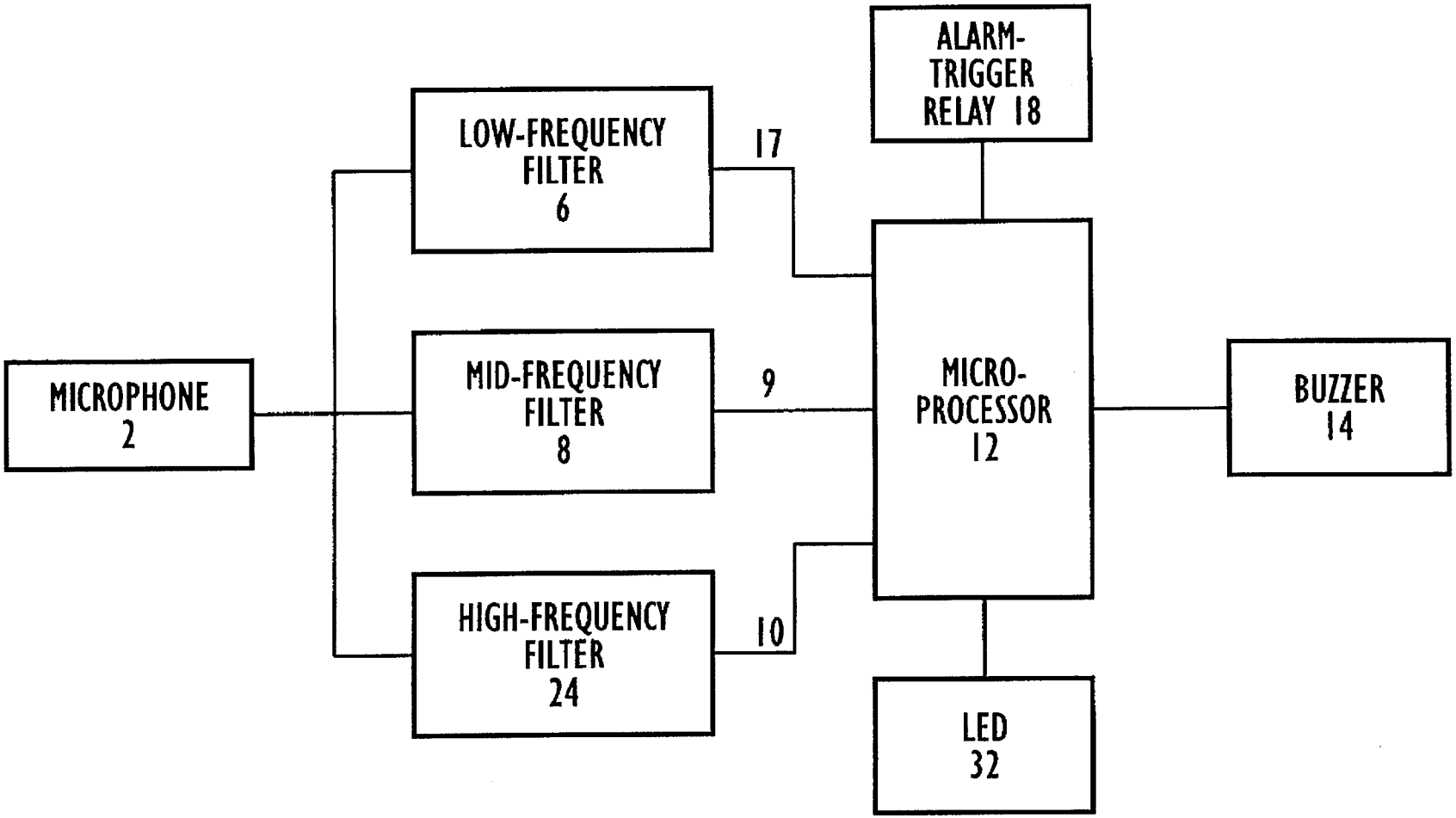
FIGS. 1 is a block diagram of the glass-break sensor of the invention.

As shown in FIG. 1, the audio signal from microphone 2 is fed through a group of audio filters 6, 8, and 24, which divide the audio signal into different audio bands. A low-frequency filter 6 isolates the low-frequency components of the audio signal. The low-frequency components preferably have a frequency of 500 Hz or less, and more preferably about 300 Hz. The output of the low-frequency filter 6 is fed to a microprocessor 12 as low-frequency signal 17.

A mid-frequency filter 8 isolates the middle-frequency components of the audio signal. The middle-frequency components are preferably in the frequency range of 3 kHz–7 kHz, and more preferably about 5 kHz. The output of this filter is fed to microprocessor 12 as mid-frequency signal 9.

A high-pass filter 24 isolates the high-frequency components of the audio signal, which preferably have a frequency of greater than 8 Khz, and more preferably about 10 kHz. The output of high-frequency filter 24 is fed to the microprocessor as high-frequency signal 10.

The processing to determine from the low-frequency 17, middle-frequency 9, and high-frequency 10 signals whether the audio signal has the audio characteristics of breaking glass, and the processing to test the system, is performed by microprocessor 12. Microprocessor 12 preferably operates using assembly language software.

Figure 3:
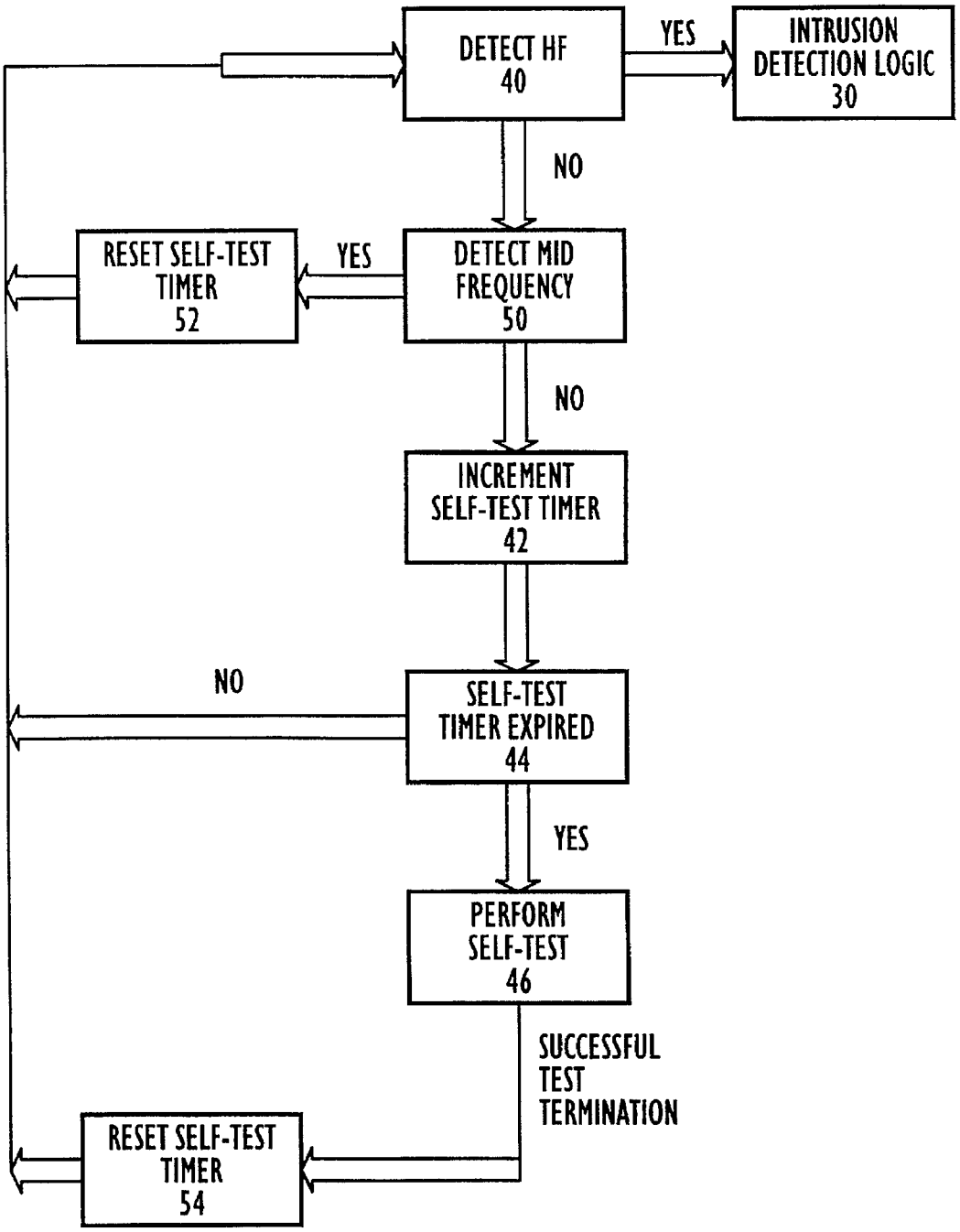
FIG. 3 is a flow chart showing the operation of the glass-break sensor of the invention during a steady-state operation.

As shown in FIG. 3, microprocessor 12 includes intrusion-detection logic 30 to determine, from the low-frequency, middle-frequency and high-frequency signals, if an alarm should be triggered. In the preferred embodiment of the invention, the high-frequency component 10 must be present in order for the intrusion-detection logic 30 to be initiated. Once a high-frequency signal has been detected, intrusion-detection logic 30 performs the determination as to whether the audio sound has the characteristics of breaking glass. As discussed above, there are numerous other methods to detect the characteristics of breaking glass in which at least two frequency components of the breaking glass are analyzed in timed relation. For example, in the aforementioned U.S. Pat. Nos. 5,164,703, 5,117,220, and 5,192,931, the low-frequency component of the breaking glass must be detected before the high-frequency component in order to initiate an alarm. The present invention is applicable to these other systems as well, and the intrusion-detection logic 30 thus does not form part of the present invention.

As shown in FIG. 3, microprocessor 12 normally operates in a steady-state mode, listening for high-frequency signal 10. If high-frequency signal 10 is detected (40), a glass break or other noise has occurred and intrusion detection logic 30 is initiated to determine, from the high, medium, and low-frequency signals whether a glass-break has occurred. A necessary pre-condition for an alarm is the presence of high-frequency signal 10. During steady-state operation, microprocessor 12 continuously listens for the presence of high-frequency signal 10. The middle-frequency and low-frequency signals 17 and 9 are only pertinent to the detection logic once high-frequency signal 10 has been detected. During steady-state operation, the system preferably listens for high-frequency signal 10 about every 70 μSec and performs the functions discussed below when not listening for the high-frequency signal.

As shown in FIG. 1, if the detection logic 30 determines that an alarm should be triggered, microprocessor 12 controls a relay 18 to turn off for approximately 4 seconds. Relay 18, which is normally closed, switches to an open condition, which notifies a separate alarm controller of the alarm condition. After 4 seconds, relay 18 is turned back on and the system returns to steady-state operation (FIG. 3). This type of triggering mechanism is well-known in the art and is not part of the present invention.

Microprocessor 12 includes a software-based timer that operates as a self-test timer. During steady-state operation, if no high-frequency signal 10 is detected, the system determines if a middle-frequency signal 9 is present (50). The self-test timer is incremented (42) during each loop in which no middle-frequency signal is detected. If a middle-frequency signal is detected, this indicates that microphone 2 is operating properly and the self-test timer is reset (52). The system then continues steady-state operation (40).

Figure 2:
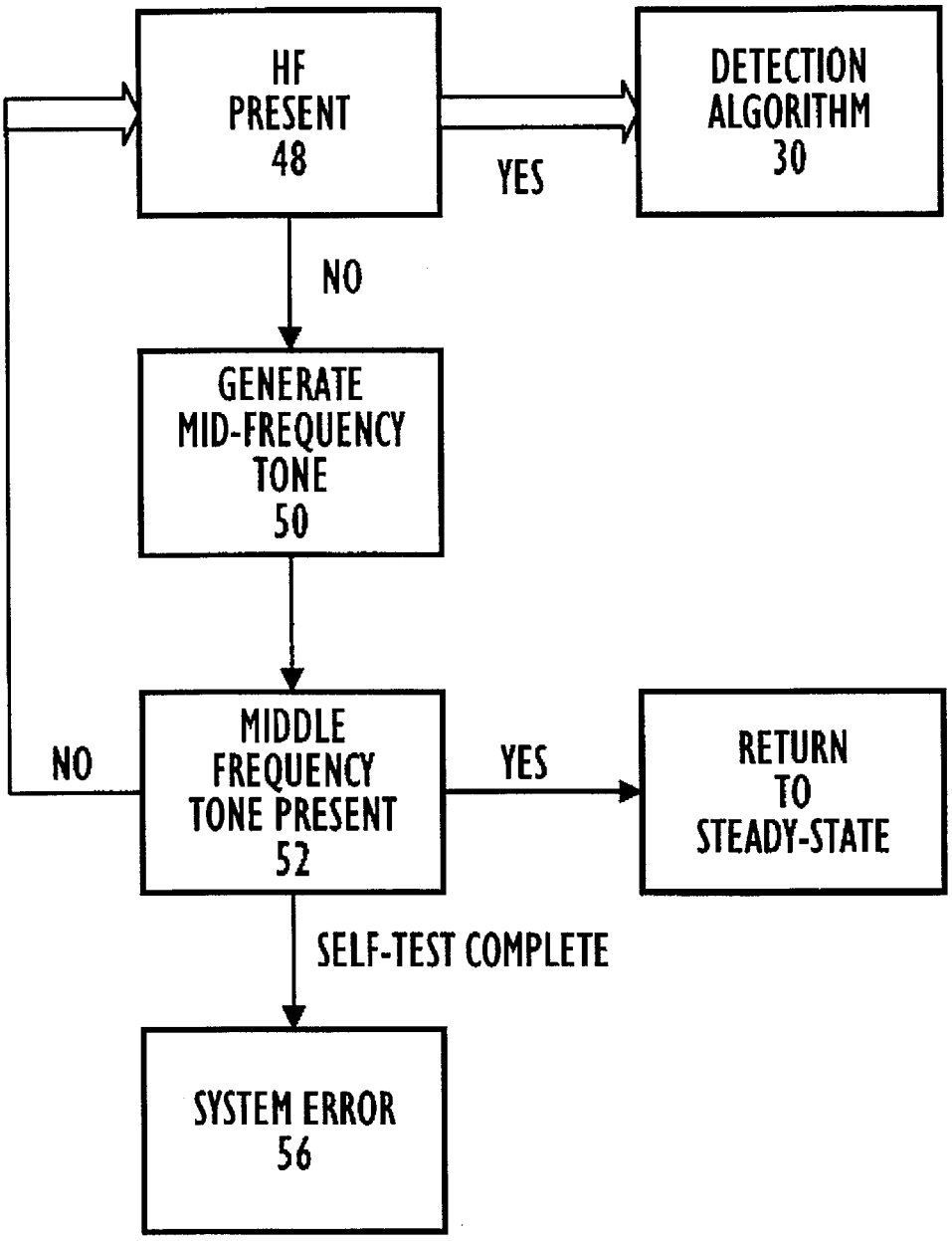
FIG. 2 is a flow chart showing the operation of the glass-break sensor of the invention during a self-test.

If no middle-frequency signal 9 has been detected and the self-test timer has expired (44), the self-test logic is activated (FIG. 2). The predetermined period of time for conducting a self-test is preferably at least several hours.

As shown in FIG. 2, when the self-test logic is activated (46), the software enters a self-test loop. Microprocessor 12 is connected to a buzzer 14 suitable for outputting a middle-frequency tone. The duration of operation of the self-test loop is preferably 4 mSec. During this time, the system outputs a middle-frequency tone (50) to buzzer 14. The system then loops to determine whether middle-frequency is present (52), i.e. whether the microphone has received the output of buzzer 14. If a middle-frequency signal is detected, the microphone is operating properly. The self-test timer is then reset (54), and the system returns to steady-state operation. If no middle-frequency signal is received within the 4 mSec buzzer tone, the microphone is not operating properly and a system error is generated (56). When a system error is generated (56), an LED 32 on the casing of the device is preferably turned on and any other appropriate error action is taken.

During the self-test loop, the system also polls for the presence of a high-frequency signal (48). If a high-frequency signal is detected during the self-test, the self-test is terminated, and control is transferred to the intrusion-detection logic 30. Thus, intrusion-detection logic 30 is not disabled during self-testing. If a high-frequency signal were to be received during a self-test, thereby indicating a possible intrusion, it would be detected within one loop of the self-test loop, i.e., within about 100 μSec. This would immediately activate the intrusion-detection logic 30, reset the self-test timer, and terminate the self-test. It is therefore possible to use the present testing system while not disabling the ability of the system to detect breaking glass.

It will be appreciated that the present testing circuit does not disable the glass-break sensor during a self-test so that the system is not vulnerable to break-in during a test. This is done by using a test sound at a frequency that is normally used by the system for detection of breaking glass but which is not the first (or trigger) frequency used for detection. In an alternative embodiment of the invention, the test sound could be at low-frequency 17, with the testing circuitry modified accordingly. It will be apparent to those skilled in the art that the present invention is also applicable to intrusion alarm systems that detect non-audio electromagnetic signals, e.g., infra-red, provided that such systems detect signals at at least two different, preferably non-overlapping, frequencies. While the preferred testing circuit operates in software on a microprocessor, it may also be implemented in an analog system.

Although the present invention has been described in detail with respect to certain embodiments and examples, variations and modifications exist that are within the scope of the present invention as defined in the following claims.

What is claimed is:

1. A testing circuit for an alarm system, the alarm system comprising (a) audio receiver/convertor means for receiving an audio sound and for converting the audio sound to an audio signal and (b) detector/generator means for detecting audio characteristics in the audio signal corresponding to breaking glass and for generating an alarm signal in response thereto, the audio characteristics corresponding to breaking glass comprising first and second frequency components in timed relation, the first frequency component having a first frequency, and the second frequency component having a second frequency different from the first frequency, wherein the first frequency must be detected prior to the second frequency for an alarm to be generated, the testing circuit comprising:

trigger means for receiving the audio signal and for detecting the first frequency component thereof, the trigger means activating the detector/generator means in response to detection of the first frequency component;

automatic self-test means for periodically generating a test audio sound at the second frequency, the trigger means remaining operable to detect the first frequency component of the audio signal during generation of the test audio sound; and means operable during generation of the test audio sound for detecting the test audio sound, said means (a) resetting the automatic self-test means in response to detection of the test audio sound and (b) generating a fault signal upon non-detection of the test audio sound.

2. The testing circuit according to claim 1 wherein the first frequency is a high-frequency signal.

3. The testing circuit according to claim 2 wherein the high-frequency signal has a minimum frequency of 10 kHz.

4. The testing circuit according to claim 1 wherein the first frequency has a frequency of not greater than 500 Hz.

5. A method of testing an alarm system, the alarm system comprising (a) audio receiver/convertor means for receiving an audio sound and for converting the audio sound to an audio signal and (b) detector/generator means for detecting audio characteristics in the audio signal corresponding to breaking glass and for generating an alarm signal in response thereto, the audio characteristics corresponding to breaking glass comprising first and second frequency components in timed relation, the first frequency component having a first frequency, and the second frequency component having a second frequency different from the first frequency, wherein the first frequency must be detected prior to the second frequency for an alarm to be generated, the testing method comprising the steps of:

receiving the audio signal and detecting the first frequency component thereof;

activating the detector/generator means in response to detection of the first frequency component;

periodically generating a test audio sound at the second frequency;

continuing to detect the first frequency component of the audio signal during generation of the test audio sound; and during generation of the test audio sound, detecting the test audio sound and (a) terminating the generation of the test audio sound in response to detection of the test audio sound and (b) generating a fault signal upon non-detection of the test audio sound.

6. The testing circuit according to claim 5 wherein the first frequency is a high-frequency signal.

7. The testing circuit according to claim 6 wherein the high-frequency signal has a minimum frequency of 10 kHz.

8. The testing circuit according to claim 5 wherein the first frequency has a frequency of not greater than 500 Hz.

9. A testing circuit for an intrusion-detection system, the intrusion-detection system comprising (a) receiver/convertor means for generating an electro-magnetic signal from a received audio signal and (b) detector/generator means for detecting intrusion characteristics in the electromagnetic signal corresponding to an intrusion and for generating an alarm signal in response thereto, the intrusion characteristics comprising first and second frequency components in timed relation, the first frequency component having a first frequency, and the second frequency component having a second frequency different from the first frequency, wherein the first frequency must be detected prior to the second frequency for an alarm to be generated, the testing circuit comprising:

trigger means for receiving the electro-magnetic signal and for detecting the first frequency component thereof, the trigger means activating the detector/generator means in response to detection of the first frequency component;

automatic self-test means for periodically generating a test signal at the second frequency, the trigger means remaining operable to detect the first frequency component of the audio signal during generation of the test signal; and means operable during generation of the test signal for detecting the test signal, said means (a) resetting the automatic self-test means in response to detection of the test signal and (b) generating a fault signal upon non-detection of the test signal.

* * * * *